US006387191B1

(12) United States Patent
Stone et al.

(10) Patent No.: US 6,387,191 B1
(45) Date of Patent: May 14, 2002

(54) RAILWAY WHEELS RESISTANT TO MARTENSITE TRANSFORMATION

(75) Inventors: Daniel Hunter Stone; Kevin James Sawley, both of Pueblo West, CO (US)

(73) Assignee: Transportation Technology Center, Inc., Pueblo, CO (US)

( * ) Notice: Subject to any disclaimer, the term of this patent is extended or adjusted under 35 U.S.C. 154(b) by 0 days.

(21) Appl. No.: 09/621,504

(22) Filed: Jul. 21, 2000

(51) Int. Cl.[7] ..... C22C 38/02; C22C 38/04
(52) U.S. Cl. ..... 148/320; 148/333
(58) Field of Search ..... 420/104, 117; 148/320, 333, 581, 583

(56) References Cited

U.S. PATENT DOCUMENTS 4,230,488 A * 10/1980 Heller et al. ..... 148/320
5,533,770 A 7/1996 Clausmeyer et al.
5,899,516 A 5/1999 Fujimura et al.

OTHER PUBLICATIONS

F. Demilly and B. Catot, Improved wheel life for heavy haul transport rolling stock, RAC, Jun. 9th–12th , 1996, pp. 5.34–5.43, Montreal.

B. Catot/F. Demilly, Improved wheel life for heavy haul transport rolling stock, Jun. 9–12, 1996, pp. 1–12, IHHA Congress, Montreal.

K.J. Sawley, Railway wheel slide damage, Engineering Against Fatigue, Mar. 1997, pp. 675–681, A.A. Balkoma, Rotterdam, Sheffield, UK.

* cited by examiner

*Primary Examiner*—Deborah Yee
(74) *Attorney, Agent, or Firm*—Dorr, Carson, Sloan & Birney, P.C.

(57) ABSTRACT

Steels having a pearlitic structure and containing 0.60 to 1.0 weight percent carbon, 1.1 to 3.0 weight percent silicon, 0.45 to 0.85 weight percent manganese, less than 0.050 weight percent sulfur and less than 0.050 weight percent phosphorus, with the remainder of said steel being iron and incidental impurities, can be used to make railway, wheels that are resistant to martensite transformations and, hence, spalling. The addition of 0.50 to 1.0 weight percent chromium to such steels further improves their resistance to spalling.

6 Claims, 8 Drawing Sheets

RAILWAY WHEELS RESISTANT TO MARTENSITE TRANSFORMATION

BACKGROUND OF THE INVENTION

1. Field of the Invention

The present invention generally relates to steel railway wheels, and especially those formulated to resist spalling caused by martensite transformations in the steel that constitutes the tread and/or flange regions of such wheels. Spalling in these wheel regions causes several problems. For example, spalling of the wheel tread will cause the wheel itself to have flat spots and the quality of "out-of-roundness". Moreover, when railway wheels experience spalling, surface cracks tend to propagate from spalled areas and cause pieces of the martensite steel to detach from the wheel, especially as the spalled area suffers rolling contact fatigue. These wheel defects also increase wheel/rail dynamic forces that produce consequential damage such as broken rails and accelerated track deterioration.

2. Description of the Prior Art

Steel railway wheels wear out as a result of normal usage. They are also prematurely removed from service as a result of spalling. Spalling occurs in railway wheel tread and/or flange regions as a result of metallurgical transformations caused by the heat generated when a train's wheels skid during brake application. In effect, these skids produce local heating to temperatures above 1300° F. (704.4° C.). These high temperatures produce metallurgical transformations in small spots of the steel in the tread and/or flange regions of such wheels. These spots transform to martensite when they cool. The resulting brittle material then cracks and falls away. Again, spalling takes place in addition to the "normal" wear experienced by railway wheels.

The railroad industry has dealt with normal wear/spalling of its wheels in three general ways: (1) machining of tread and flange surfaces, (2) scrapping the wheel and (3) imparting improved metallurgical properties to those steels from which railway wheels are made. As far as scheduled and unscheduled machining of railway wheels are concerned, it should be noted that, since normal wear/spalling of railway wheels has certain safety implications, these matters are the subject of governmental regulation. In the United States for example, the Federal Railroad Administration ("FRA") has promulgated various regulations concerning the dimensions of various parts of a railway wheel's profile. Many of these regulations express themselves in terms of the height and width of a railway wheel's flange.

For example, these regulations call for new (or newly machined) wheel flanges to have a height of $^{16}/_{16}$'s inches (i.e., 1 inch) and a width of $^{21}/_{16}$'s inches (i.e., $1^{5}/_{16}$ inches). A railway wheel is considered to be in violation of FRA regulations if the height of its flange—as measured from the crown of the tread surface of the wheel—reaches $^{24}/_{16}$'s inches (i.e., 1½ inches), or if the width of the wheel flange reaches $^{15}/_{16}$'s inches. If a wheel reaches either of these states of wear, it should be machined to the required dimensions or scrapped. Those skilled in the railway wheel maintenance arts will appreciate that in order to achieve these dimensions in a worn wheel, a great deal of the wheel metal is machined away—and hence, "wasted". This waste has a very direct bearing on a wheel's useful life. Hence, many machining procedures have been employed to minimize such waste. For example, U.S. Pat. Nos. 4,134,314 and 4,711,146 teach several wheel reprofiling machining techniques that serve to bring railway wheels back into compliance with regulations with minimum waste of wheel tread and flange material.

Ideally, the steel from which railway wheels are made would have high levels of at least two general properties. They would be highly wear resistant; and they also would be highly heat-crack resistant. Unfortunately, these two properties have certain contrary metallurgical aspects, especially in the context of railway wheel exposure to the heat generated by heavy braking situations. The first metallurgical problem arises because, in order to enhance its wear resistance, the hardness of the steel must be raised. Unfortunately, increased hardness in a steel usually implies decreased spall resistance. On the other hand, making a steel more spall resistant usually implies that the steel will be less hard, and hence less wear resistant. Moreover, both of these properties (wear resistance and spall resistance) must be achieved without greatly sacrificing the pearlitic structure that imparts the quality of wear resistance to a steel.

Generally speaking, increased hardness can be brought about through addition of certain alloying elements (in certain concentrations) to a steel formulation. For example, when wear resistance is the more desired property, high carbon steels having carbon contents ranging from about 0.65 to about 1.0 weight percent are employed. Such steels are especially hard and, hence, especially wear resistant. Such steels are not, however, particularly spall resistant.

Their loss in spall resistance generally follows at least in part from the fact that martensitic crystalline structures (or bainitic crystalline structures) are more likely to be produced in those railway wheel steels alloyed to gain greater hardness. These martensite crystalline structures are produced when frictional heat is imparted to railway wheel tread/flange areas in braking situations where wheel slide takes place. Such heat is often sufficient to raise temperatures of the tread/flange steel to austinite-producing levels in those local regions known as "hot spots". Thereafter, because the rest of the railway wheel serves as a heat sink, hot spot temperatures are quickly lowered to martensite-forming levels. Thus, in a braking situation, local areas of the tread and/or flange are transformed from pearlite to austenite to martensite as their steel rapidly heats—and rapidly cools.

Viewing the overall hardness versus heat-cracking resistance problem from the spalling resistance point of view, one finds that other alloying materials (and/or other concentrations of certain commonly employed alloying materials such as carbon) have been added to (or, in the case of carbon, reduced) certain steel formulations for the specific purpose of imparting spall resistant qualities to railway wheels. For example, medium carbon steels having carbon contents ranging from about 0.45 to about 0.55 weight percent have proved to be more spall resistant than the previously noted harder steels having 0.65 to 0.85 carbon concentrations. It also has been found that many of the other alloying materials (and/or different concentrations of identical alloying materials, e.g., the different carbon concentrations noted above) tend to have unacceptably low wear resistance. Thus, this wear resistance versus spall resistance problem has a certain dilemmatic quality that has for many years thwarted the industry's attempts to extend the useful life of railway wheels.

Those skilled in this art also will appreciate that spalling has proven to be the more intractable aspect of the wear resistance versus heat crack resistance dilemma. This generally follows from the fact that normal wear is somewhat predictable, and gradual, in nature. Heat producing wheel skids on the other hand are relatively unpredictable. Worse yet, spalling tends to produce damage that is much more immediate and much more severe in nature. Nonetheless, most prior art railway wheel steel compositions tend toward satisfying railroad industry requirements for greater wear resistance, while "silently" conceding that spalling due to heat cracking caused by wheel skids will be dealt with by: (1) physically machining railway wheel tread/flange regions on a scheduled basis to meet the wheel flange dimension requirements previously noted, or (2) by machining heavily spalled wheels on an "as needed" basis, or (3) by simply scrapping the wheel.

To some extent, the patent literature reflects the railway industry's attempts to deal with the wear resistance vs. heat crack resistance dilemma. For example, U.S. Pat. No. 5,533,770 ("the '770 patent") teaches certain steel formulations that produce particularly hard (and, hence, particularly wear resistant) railway wheels. These formulations are characterized by their specific ratios of carbon to chromium to nickel. They also are characterized by a specific upper threshold for their silicon content and their low upper thresholds for phosphorus and sulfur. These steels are disclosed as having, in percent by mass, the following compositions:

carbon: 0.380–0.420 silicon: ≦0.250 manganese: 0.400–0.600 phosphorus: ≦0.012 sulfur: ≦0.005 chromium: 1.000–1.500 molybdenum: 0.300–0.600 nickel: 0.700–1.200 aluminum: 0.015–0.040 nitrogen ≦0.008

Preferably, these steel formulations also are sequentially subjected to certain physical conditions during their overall manufacture in order to further improve their hardness. For example, they are subjected to: (1) hardening at 850° to 900° C., (2) quenching at room temperature at about 20° C., (3) annealing at 600° to 680° and (4) slow cooling to room temperature at about 20° C. These physical steps are all taken in order to enhance the steel's wear resistant properties. Unfortunately, these formulations and cooling procedures do not impart particularly good heat-cracking resistance properties in the wheels made from them.

Similarly, Japanese Laid-Open Patent Application 57-143465 ("Japanese Laid Open '465 Application") discloses wear-resistant railway wheel steels having fine pearlitic structures. They consist of 0.55 to 0.80% C, 0.40 to 1.20% Si, 0.60 to 1.20% Mn, 0.20 to 0.70% Cr, with the remainder being iron (and trace impurities). The hardenability of the resulting steels is very high. Here again however, such steels have proven to be inclined toward heat-cracking as a result of martensitic transformations in heavy braking situations.

U.S. Pat. No. 5,899,516 ("the '516 patent") is of particular interest with respect to the present patent disclosure because it discloses railway wheels made from steels that are specifically designed to overcome the heat-cracking problems associated with the steels described in the above-noted Japanese Laid-Open '465 Application—while still providing good hardenability properties in such steels. The steels disclosed in the '516 patent have the following compositions:

carbon: 0.4% to 0.75% silicon: 0.4% to 0.95% manganese: 0.6% to 1.2% chromium: less than 0.2% phosphorus: 0.03% or less sulfur: 0.03% or less

Moreover, the manufacturing processes used to produce railway wheels made from these steels include some very specific quenching operations. These quenching operations are intended to interrupt cooling of the steel in a railway wheel's tread region before the steel's cooling curve drops to the steel's martensite forming conditions. Indeed, these quenching operations interrupt cooling of the steel before the cooling curve drops to the pearlitic transformation conditions associated with these steel compositions. As a result of these interruptions in the cooling of this steel during the wheel's manufacture, a particularly fine pearlitic structure is imparted to the steel without the steel experiencing either a martensitic transformation or a bainitic transformation. The '516 patent also teaches interruption of its cooling operation after the cooling curve has passed through the steel's pearlite transformation region, but before said curve descends to the steel's martensite transformation region. Thus, the steels taught by the '516 patent have fine pearlitic structures and nicely avoid martensitic transformation conditions that might otherwise be encountered during the manufacture of these steels—and the wheels made from them. Unfortunately, however, many martensite transformation conditions produced by the heat generated by heavy braking conditions do not coincide with the martensite transformation conditions that can be avoided in highly controlled manufacturing processes such as those disclosed in the '516 patent.

However, before delving into applicants' methods for producing railway wheels that are more resistant to the martensite transformations that result from heavy braking situations, a few general observations about steel transformations in general, and martensite transformations in particular, may be helpful. Those skilled in the steel making arts will appreciate that martensite transformations take place when a steel having an austenite structure transforms to a steel having a martensite structure as a result of a rapid cooling of an austenite steel. It might also be emphasized at this point that martensite can not be directly produced from a steel whose metallurgical structure is pearlitic in nature. Next we note that a martensite transformation from austenite does not involve any change in chemical composition. That is to say there is no nucleation followed by growth in a martensite transformation product. Rather, small discrete volumes of the parent austenite solid solution, very suddenly, change to the martensite crystal structure. Indeed, the time of formation of a single plate of martensite in iron-nickel alloys can be on the order of about $7\times10^{-5}$ seconds. Such very short transformation times have a considerable bearing on applicants' inventive concept. Therefore, a great deal more will be said about the implications of these short martensite transformation times in subsequent parts of this patent disclosure.

For now however, a few other observations about martensite are in order. For example, it should be understood that a martensite transformation progresses only while the steel is cooling (that is to say that more and more discrete volumes of the parent austenite solid solution transform as the steel cools). It also should be appreciated that martensite transformations cease if cooling is interrupted. Thus, a martensite transformation is independent of time and depends for its progress only on decrease in temperature. It might also be noted at this point that the term $M_s$ is applied to the temperature of the start of a martensite formation; similarly, the term $M_f$ indicates the temperature of the finish of a martensite transformation. It also should be noted that the amount of martensite formed per degree of decrease in temperature is not a constant (i.e., the number of martensite crystalline units produced at first is small, increases rapidly as the temperature continues to decrease, but eventually decreases again).

Those skilled in the steel making arts also will appreciate the following related points:

(1) Austenite is an allotropic form of iron called "gamma" with carbon in solution. Austenite transforms to various other products (including martensite) on cooling below 723° C. The nature of these other products depend to a large degree upon the rate of cooling of the austenite.

(2) Ferrite (virtually pure iron) has an upper limit of existence that is lowered progressively to about 723° C. as the steel's carbon content increases up to 0.83%.

(3) Cementite, iron carbide $Fe_3C$, is one of the products that can be precipitated when austenite cools.

(4) Pearlite is a eutectoid comprised of a laminated structure of ferrite and cementite. Pearlite is formed by transformation of austenite upon cooling. The fineness of a pearlite's laminated structure is determined in large part by the rate of cooling. The lamellar structure of ferrite and cementite in pearlite produces its highly desired quality of wear resistance.

Thus, even though a great deal is known about martensite transformations, the fact remains that such transformations are responsible for a great deal of the accelerated wear of railway wheels through spalling of railway wheel tread/flange regions as a result heavy braking. It is therefore an object of this invention to provide steels for railway wheels that have increased spalling resistance by virtue of their ability to avoid martensite transformation conditions.

BRIEF DESCRIPTION OF THE DRAWINGS

FIG. 2 also shows a second cooling curve (shown as a dotted line B) that depicts the consequences of interrupting the cooling of this 1.0% silicon-containing steel by a quenching process.

SUMMARY OF THE INVENTION

Figure 1:
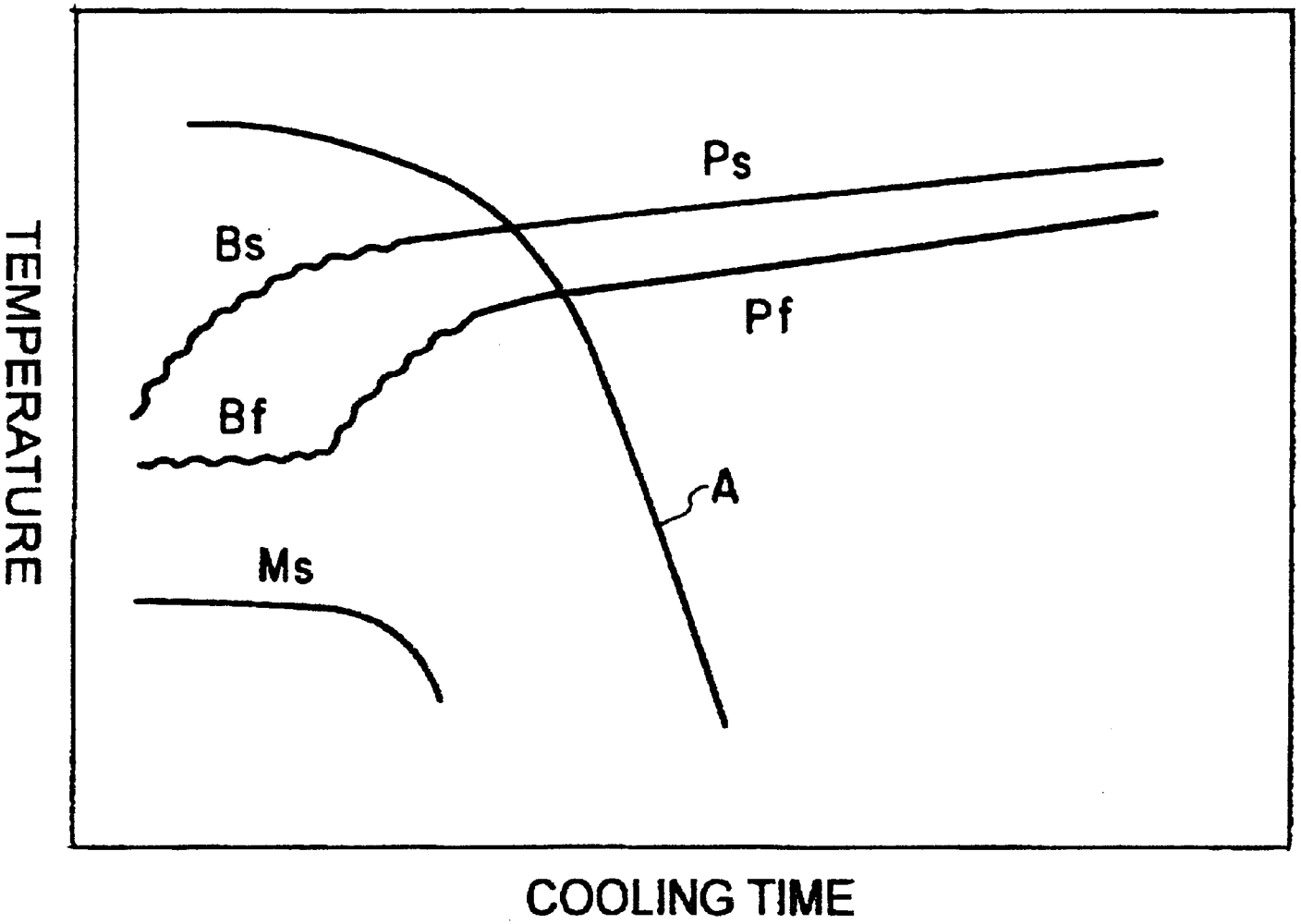
FIG. 1 is a continuous cooling transformation curve diagram of a steel having 0.25% silicon.

Applicants have found that the wear resistance versus heat crack resistance "dilemma" can be dealt with through use of steels whose pearlite formation region is shifted toward the left (i.e., toward the Y, or temperature, axis of a continuous cooling transformation curve diagram) to such an extent that, after a railway wheel skid, the hot spot steel's cooling curve will encounter at least some part of the shifted pearlite formation region before said curve encounters the steel's martensite-formation temperature conditions (e.g., before it encounters the steel's martensite starting temperature curve $M_s$). Obviously, the path of such a cooling curve would change if the X and Y axes were interchanged. It is a convention in this art however to associate time with the X axis and temperature with the Y axis in such diagrams. Therefore, applicants will follow this convention throughout this patent disclosure.

Applicants also have found that the likelihood that a pearlite steel will transform to austenite under braking conditions can be reduced by the presence of certain levels of silicon in the steel formulations of this patent disclosure. This likelihood can be reduced even further by adding certain levels of chromium to applicants' steel formulations.

Be that as it may, applicants have found that certain railway wheel steels having pearlitic structures, carbon concentrations of 0.60 to 1.0 weight percent and particularly high silicon concentrations (between 1.1 and 3.0 weight percent) will display pearlite formation regions in general, and pearlite starting curves $P_s$ in particular, that are shifted far enough to the left in a continuous cooling transformation curve diagram, that they will encounter a cooling curve that descends from austenite-forming temperatures to temperatures less than about 300° C. (and even less than about 200° C.), in less than about one second—and in many cases less than about one tenth of a second (or even as little as about one hundredth of a second). The steels of this patent disclosure will preferably contain certain other alloying ingredients such as manganese. The remainder of applicants' steels is of course iron and various trace impurities that are normally found in steels in general. It is, however, also a preferred embodiment of this invention that the steels of this patent disclosure contain less than 0.05 weight percent sulfur and less than 0.05 weight percent phosphorous.

Steel formulations characterized by a pearlitic microstructure and containing 0.60 to 0.77 weight percent carbon, 1.1 to 3.0 weight percent silicon, 0.45 to 0.85 weight percent manganese, less than 0.05 weight percent sulfur and less than 0.05 weight percent phosphorus, (with the remainder of the steel being comprised of iron and incidental or trace impurities) make railway wheels that are particularly resistant to martensite formations. Such formulations wherein the carbon concentration is from about 0.67 to 0.77 weight percent are particularly preferred. Such steels also are less likely to undergo pearlite to austenite transformations, especially in the short heating and cooling times associated with railway wheel skids.

Pearlitic steels containing 0.60 to 0.77 weight percent carbon, 1.1 to 3.0 weight percent silicon, 0.45 to 0.85 weight percent manganese, 0.50 to 1.0 weight percent chromium, less than 0.050 weight percent sulfur and less than 0.050 weight percent phosphorus (with the remainder of the steel being iron and incidental impurities) are even more martensite resistant. They also are even less likely to undergo pearlite to austenite transformations (i.e., less likely than comparable steels having no chromium component). They are, however, owing to the cost of their chromium component, somewhat more expensive to manufacture.

It might be further noted here that, within the 1.1 to 3.0 weight percent range for silicon in applicants' steels, there are at least three sets of preferred ranges—depending on the concentrations of the other alloying materials employed. For example, silicon concentrations of 1.1 to 2.0; 1.3 to 2.5 and 2.0 to 3.0 weight percent can produce particularly effective steels for the practice of this invention depending on the precise concentrations selected within the concentration ranges for those other alloying materials, e.g., depending upon the carbon concentration selected between 0.60 to 0.77, the manganese concentration selected between 0.45 and 0.85 and the chromium concentration selected between 0.5 to 1.0 weight percent.

The teachings of the '516 patent are a useful starting point for understanding the metallurgical concepts associated with, and the technical implications of, the use of applicants' alloying ingredient concentrations. Hence, the teachings of the '516 patent are incorporated herein by reference. Indeed, FIG. 1 of the present patent disclosure is a replica of FIG. 1A of the '516 patent. Similarly, FIG. 2 of this disclosure is a replica of FIG. 1B of the '516 patent. FIG. 1 is a continuous cooling transformation curve diagram of a steel having, among its other alloying ingredients, a 0.25% silicon concentration. The diagram describes various relationships between this steel's pearlitic transformation start curve $P_s$, pearlitic transformation finish curve $P_f$, bainitic transformation start curve $B_s$, bainitic transformation finish curve $B_f$, martensitic transformation start curve $M_s$ and a cooling curve A for the steel. This cooling curve A starts in the upper left corner of the diagram. This location is generally associated with a relatively high temperature and a relatively short period of time. Since the upper left corner starting point of cooling curve A is above the pearlite transformation start curve $P_s$, the upper left end of curve A can be thought of as beginning in an austenite region of this diagram. As time passes, the cooling curve A generally proceeds rightward and downward. It first passes through a pearlite forming region of the diagram that is generally bounded by a pearlitic transformation start curve $P_s$ and a pearlitic transformation finish curve $P_f$. Cooling curve A's descent through the $P_s$–$P_f$ region implies that the end product steel will take on a pearlitic crystalline structure.

It is important to bear in mind, however, that the cooling curve A depicted in FIG. 1 results from conditions that occur during manufacture of that steel. Curve A does not necessarily depict the conditions that occur during railway wheel use—especially under the conditions produced by wheel skids resulting from heavy braking situations. In other words, the descent of curve A in FIG. 1 may well take place in time periods (represented by movement of curve A to the right in FIG. 1) that are significantly longer than the time periods in which a hot spot of a skidding railway wheel heats up—and then cools down.

Figure 2:
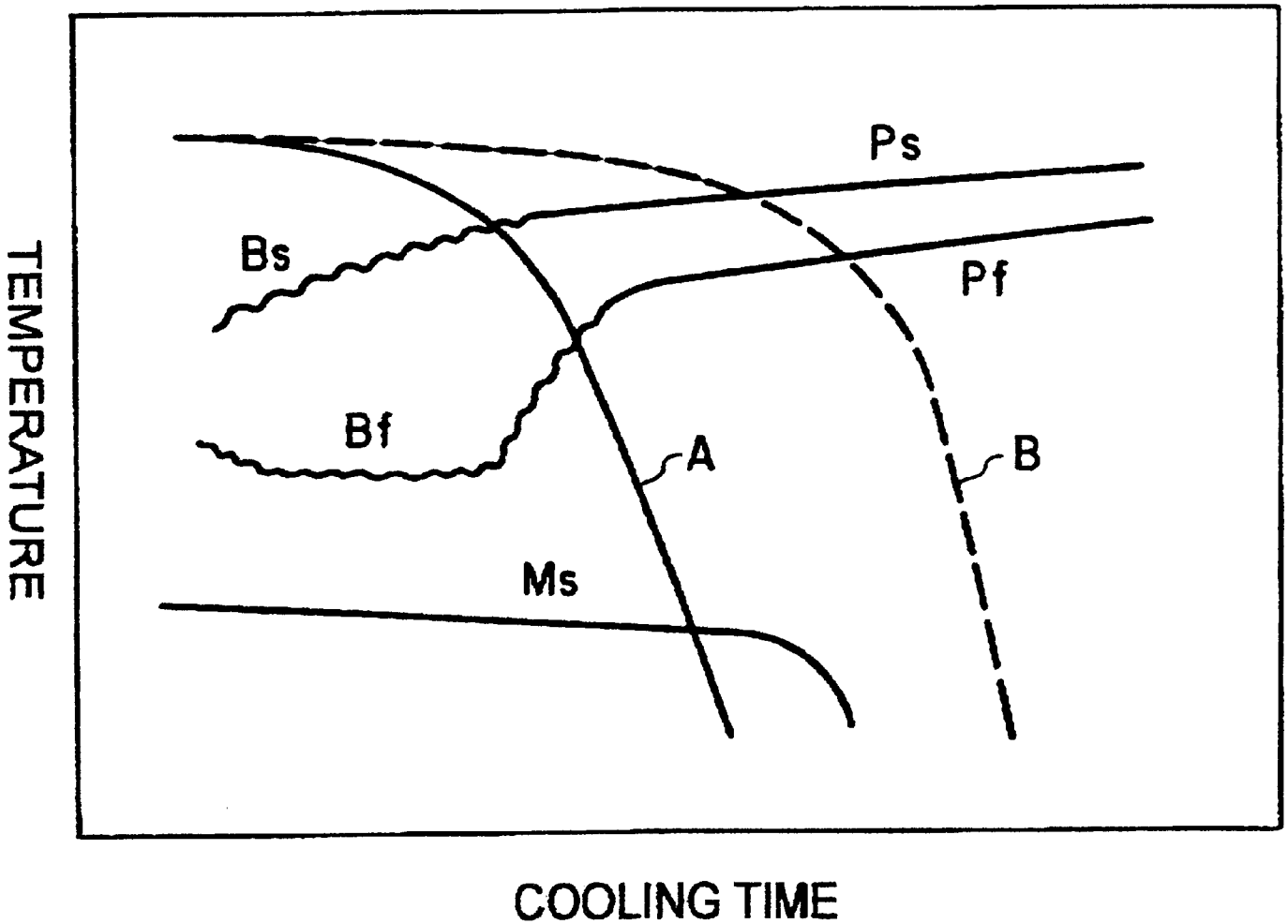
FIG. 2 is a continuous cooling transformation curve diagram that shows the effect of raising the silicon concentration of a steel from the 0.25% level associated with FIG. 1 to a 1.0% level.

FIG. 2 shows a first cooling curve A (similar to curve A in FIG. 1) and a second cooling curve B (shown as a dotted line) that depicts the consequences of interrupting the cooling of this steel by a quenching process disclosed in the '516 patent. The steel that generated the continuous cooling transformation curve diagram of FIG. 2 differs from the steel that generated FIG. 1 in that the steel associated with FIG. 2 has, among its other alloying ingredients, a 1.0 percent silicon concentration (as opposed to the 0.25 percent silicon concentrations of the steel associated with FIG. 1). Among other things, this increase in silicon concentration would normally cause cooling curve A to pass through a bainitic steel forming region (bounded by "wavy" curves $B_s$ and $B_f$) rather than pass through a pearlitic steel forming region (bounded by "smooth" curves $P_s$ and $P_f$). The 1.0 percent silicon concentration implicit in FIG. 2 also causes the martensite transformation start curve $M_s$ to extend further to the right (relative to its position in FIG. 1). Thus, cooling curve A would penetrate the $M_s$ curve and continue on into the martensite forming region of this diagram. These are both undesirable outcomes because a steel having either a bainitic crystalline structure or a martensite crystalline structure is much more likely to spall relative to a steel having a pearlitic crystalline structure.

FIG. 2 also depicts how the quenching operations taught by the '516 patent cause cooling curve B to avoid the bainitic region ($B_s$–$B_f$) and the martensitic region ($M_s$ and below). They are avoided by quenching the steel in such a way that the steel's cooling curve is shifted to the right in FIG. 2. Again, this shift to the right is depicted by cooling curve B. Cooling curve B is shown passing through a pearlitic steel forming region $P_s$–$P_f$ (rather than passing through a bainitic steel forming region $B_s$–$B_f$ a 1*a* cooling curve A of FIG. 2) and then passing to the right of the rightwardly extended martensite transformation curve $M_s$ that is associated with this 1.0 percent silicon steel.

Moreover, the quenching procedure that produces dotted line B in FIG. 2 also causes the cooling time to be increased relative to the cooling time associated with cooling curve A. In other words, cooling curve B is farther to the right on the X axis (time axis) relative to cooling curve A. It also bears repeating that this quenching-induced shift of curve B to the right—to such an extent that it avoids (i.e., falls to the right of) the martensite transformation curve $M_s$—takes place in the context of a highly controlled manufacturing operation.

Those skilled in this art will, however, fully appreciate that, when a railway wheel skids (e.g., as a result of heavy braking action), a pearlite steel (a laminated ferrite/cementite system) from which the wheel was originally made is very rapidly heated up in local hot spot regions. These hot spots generally range from about the size of a U.S. ten cent piece to about the size of a U.S. twenty five cent piece. The temperatures of such hot spots are often high enough to transform the steel from its original pearlite crystalline structure to a steel having an austenite crystalline structure.

This heating can occur in time periods as short as one second or less; indeed it can occur in time periods of one thousandth of a second or less. Worse yet, these hot spots can cool just as rapidly (again, in time periods of one second or less, and sometimes in time periods of one tenth of a second or less). This rapid cooling follows from the fact that the rest of a wheel beyond such a hot spot acts as a heat sink with respect to the heat generated at the hot spot. Thus, the hot spot steel very quickly heats—and then very quickly cools.

Figure 3:
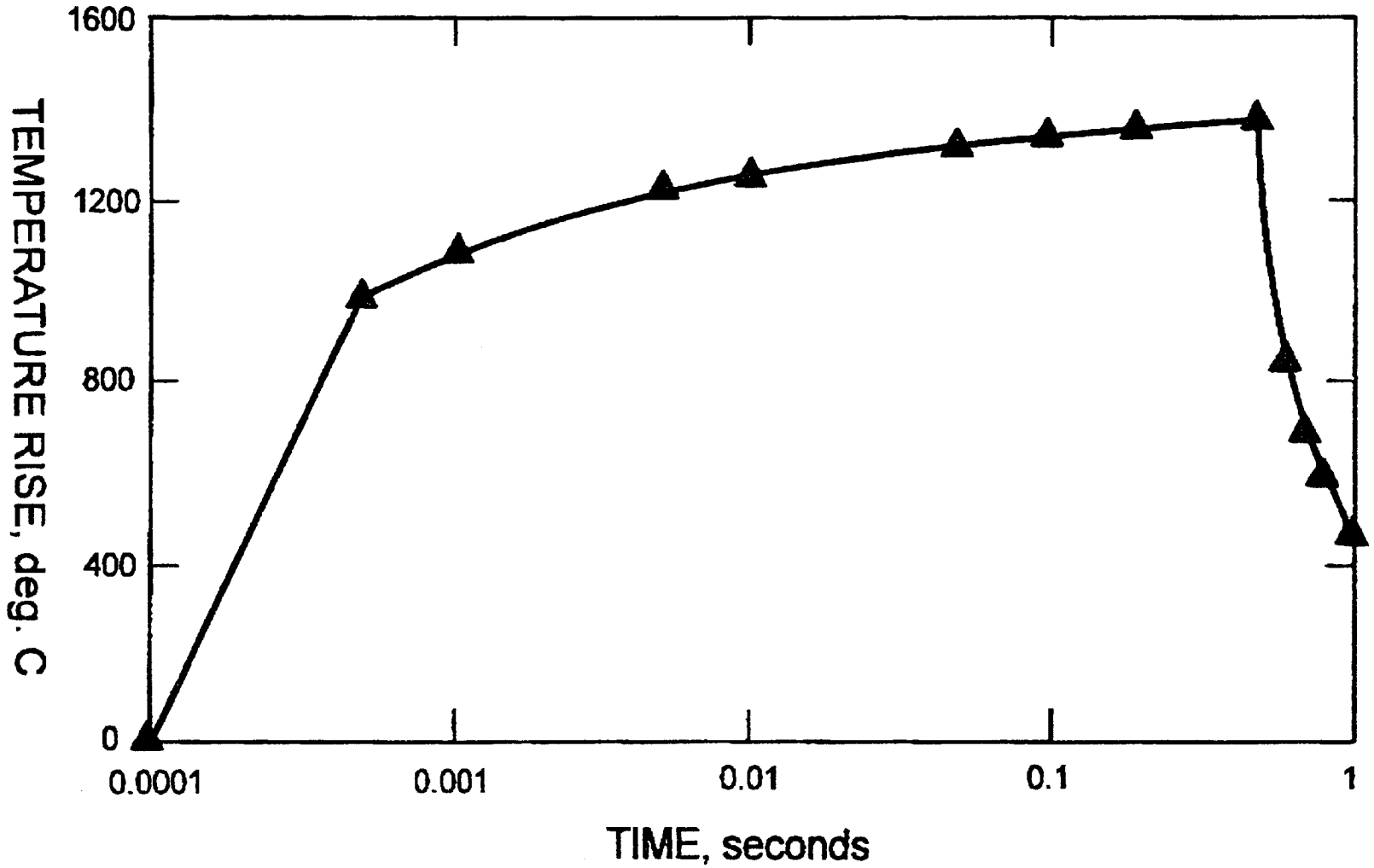
FIG. 3 shows the rise and fall of temperature of a railway wheel hot spot resulting from a wheel skid.

FIG. 3 generally illustrates the speed at which, and the temperatures to which, hot spot steels are heated, and then cooled, in skid situations. It is adapted from a graph given on page 679 of an article entitled "Railway Wheel Slide Damage", K. J. Sawley, *Engineering Against Fatigue,* Sheffield, U.K. (March 1997), Pub. A A Balkoma, Rotterdam, Holland, Eds. J. H. Bayron, R. A. Smith, T. C. Lindloom and B. Tomkins. This article is incorporated herein by reference. More specifically, FIG. 3 depicts the calculated temperature rise and fall in a hot spot region of a railway wheel in a skid wherein a BR Mark III coach (wheel load 42,000 N) slides at 40 $ms^{-1}$ for 0.5 sec. The calculation assumed a contact patch having 0.01 m×0.01 m surface dimensions and a wheel/rail adhesion of 0.075 (just under a maximum brake demand of 0.09 g). The graph shows that hot spot steel temperatures can rise very, very rapidly. In FIG. 3, for example, the hot spot steel temperature reaches almost its highest level within about 5 milliseconds from the start of the slide. The subsequent cooling of this hot spot steel also takes place very, very rapidly. Note for example how quickly the curve drops from about 1200° C. to about 400° C. In short, these cooling conditions are sufficient to cause transformation of the austenite produced by the high temperatures (e.g., 800–1200° C.) to a steel having a martensite structure.

Figure 4:
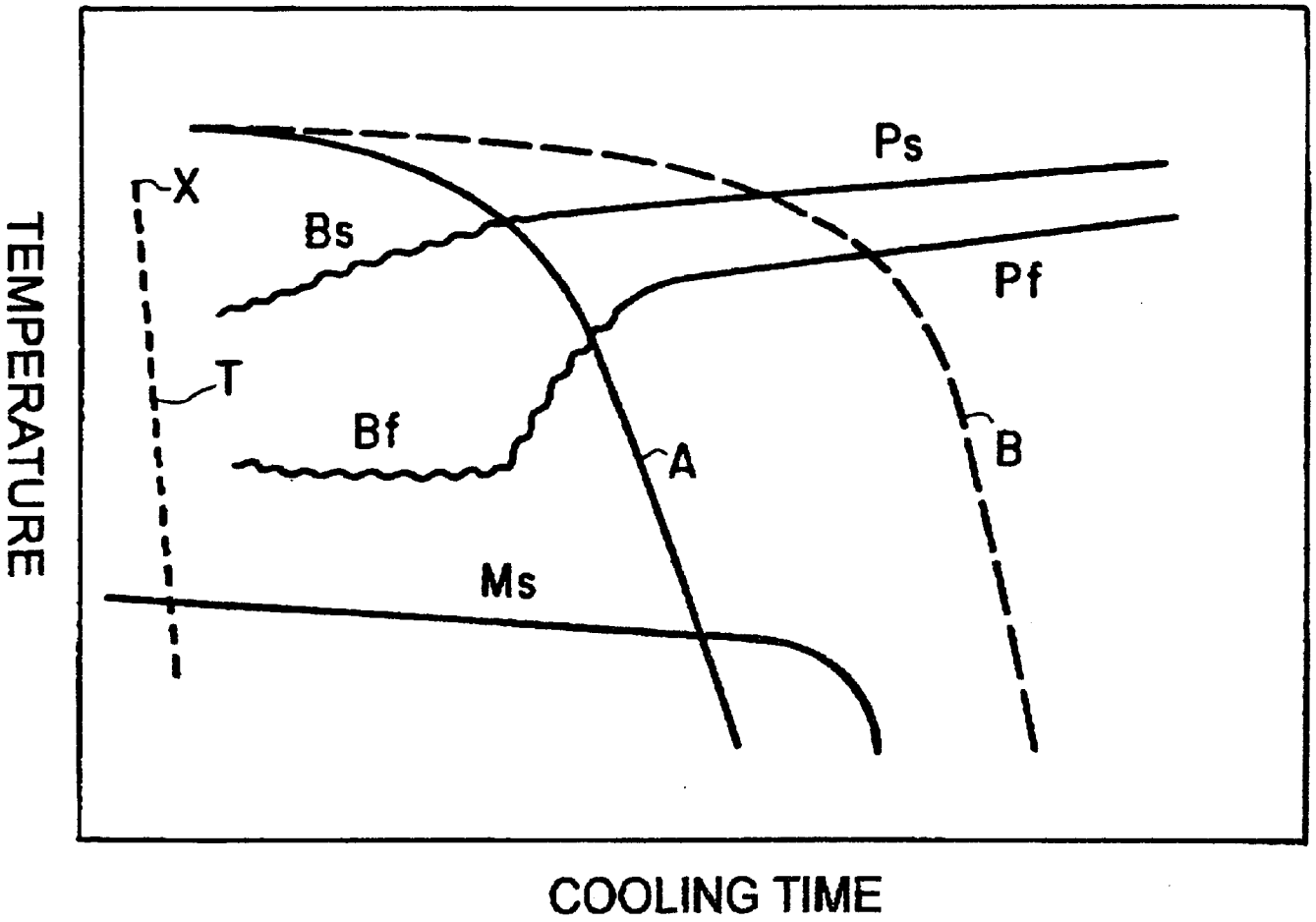
FIG. 4 is a continuous cooling transformation curve diagram showing a cooling curve T that descends from an austenite-producing temperature X to martensite-forming conditions (e.g., to curve $M_s$ and below) in a very short period of time relative to the times implicit in curve B of FIG. 2.

These heating and cooling conditions also can be related to the continuous cooling transformation curve diagram shown in FIG. 2. To this end, FIG. 4 is a continuous cooling transformation curve comparable to that shown in FIG. 2 of this patent disclosure (which was taken from the '516 patent). In FIG. 4, however, the temperatures produced in a hot spot in a railway wheel as a result of a wheel skid (such as those depicted in FIG. 3) is shown raised to a high level generally depicted as point X in FIG. 4. Point X generally corresponds with a temperature of about 850° C. to 1200° C. Therefore, point X is located in the austenite region of the diagram that generally lies above the steel's $P_s$ curve. FIG. 4 shows that the rise in temperature as having taken place in a very short period of time (e.g., one tenth of a second). A dotted line i.e., cooling curve T is shown descending from point X toward the time axis (i.e., X axis). This fall in temperature takes place in a very short period of time as well (e.g., in less than one tenth of a second). Thus, under these conditions, cooling curve T is shown descending virtually vertically from point X and passing through the martensite starting temperature curve $M_s$. Hence, under these conditions, at least some of the steel in the hot spot region will take on a martensite crystalline structure. Again, this is an undesired event since steel having a martensite crystalline structure is much more likely to spall relative to a steel having a pearlite structure.

FIG. 4 therefore illustrates how little time is taken to produce a hot spot—and then to cool it—relative to the cooling time periods generally associated with quenching operations such as those whose metallurgical consequences are depicted in FIGS. 1 and 2. Thus, since the steel in hot spot regions on railway wheels are heated to austenite-forming temperatures in very short time periods, and then lowered to martensite-forming temperatures in very short time periods as well, it would appear that steel formulations other than those disclosed in the '516 patent are required in order to more effectively deal with the heat crack resistance problem. In other words, even though the steel formulation and quenching processes taught in the '516 were intended to prevent heat-cracking (without sacrificing hardness in the steel), the purpose of these formulations and processes will, at least in part, be negated if the heating/cooling process takes place in a time period that is significantly less than the time periods associated with curve B of FIG. 2. It also should be noted that, due to the rightward shift of cooling curve B relative to cooling curve A, it is even more likely that the greater time period associated with this rightward shift of curve B in FIG. 2 is such that it is significantly longer than the time periods in which a hot spot of a skidding wheel heats up—and cools down. Again, FIG. 3 depicts the results of a slid test wherein the steel was heated to about 1200° C. and then cooled back down to about 400° C. in about 1 second. By way of contrast, FIGS. 1 and 2 were produced in the context of quenching operations that produce cooling curves A and B that most probably lie far to the right of applicants' cooling curve T.

DETAILED DESCRIPTION OF THE INVENTION

Figure 5:
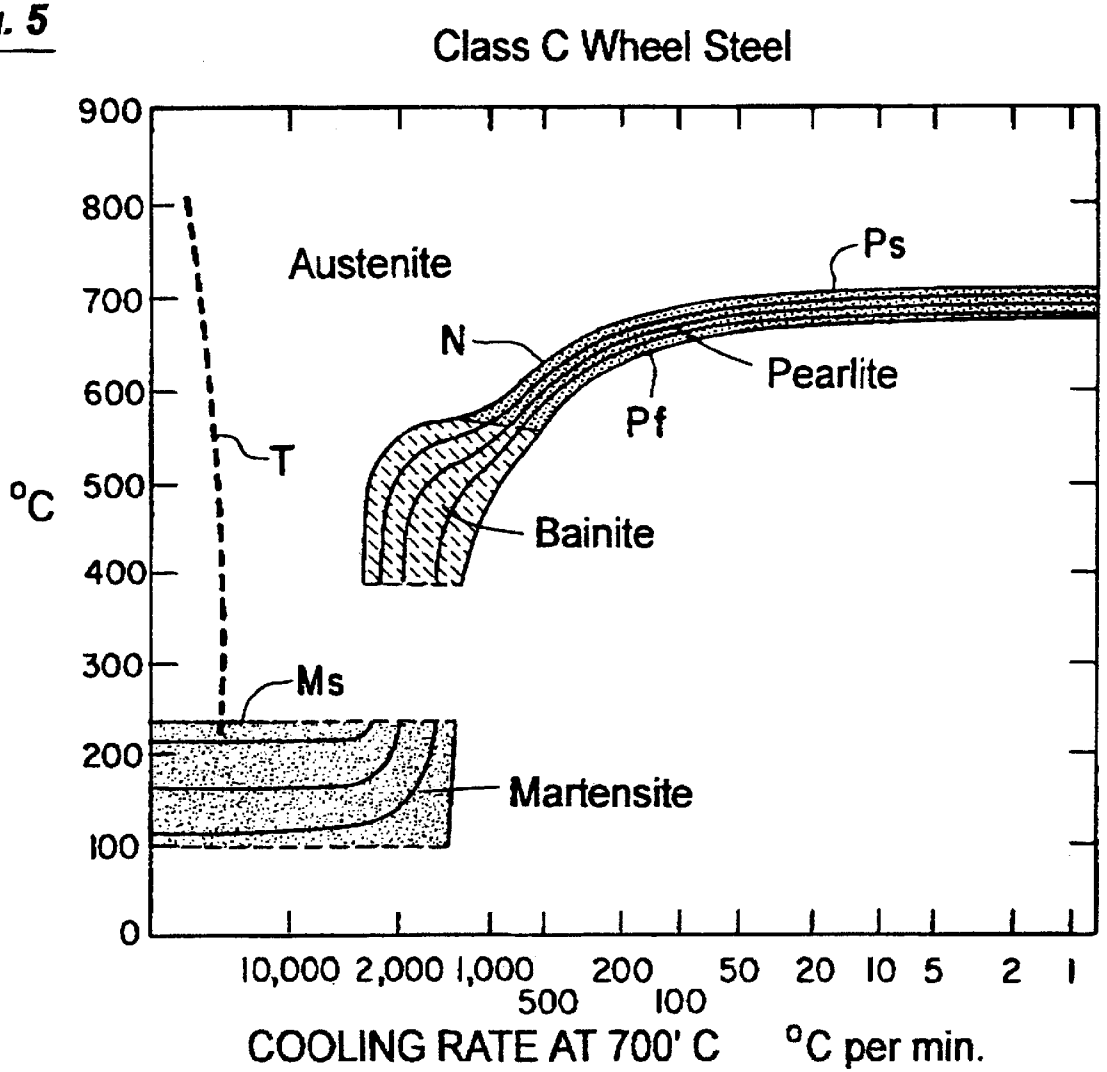
FIG. 5 is a continuous cooling transformation curve diagram for a Class C Wheel Steel having 0.75% C, 0.33% Si, 0.70% Mn, 0.017% P and 0.016% S.

FIG. 5 is a continuous cooling transformation curve diagram for a Class C Wheel Steel. It is adapted from a drawing appearing in: Atlas of Continuous Cooling Transformation Diagrams for Engineering Steels. This particular steel contains 0.75 percent carbon, 0.33 percent silicon, 0.70 manganese, 0.017 percent phosphorous and 0.016 percent sulfur. The nose region N of the $P_s$ curve is well to the right of cooling curve T. Hence, the cooling curve T descends in an uninterrupted manner to the steel's martensite formation region.

Figure 6:
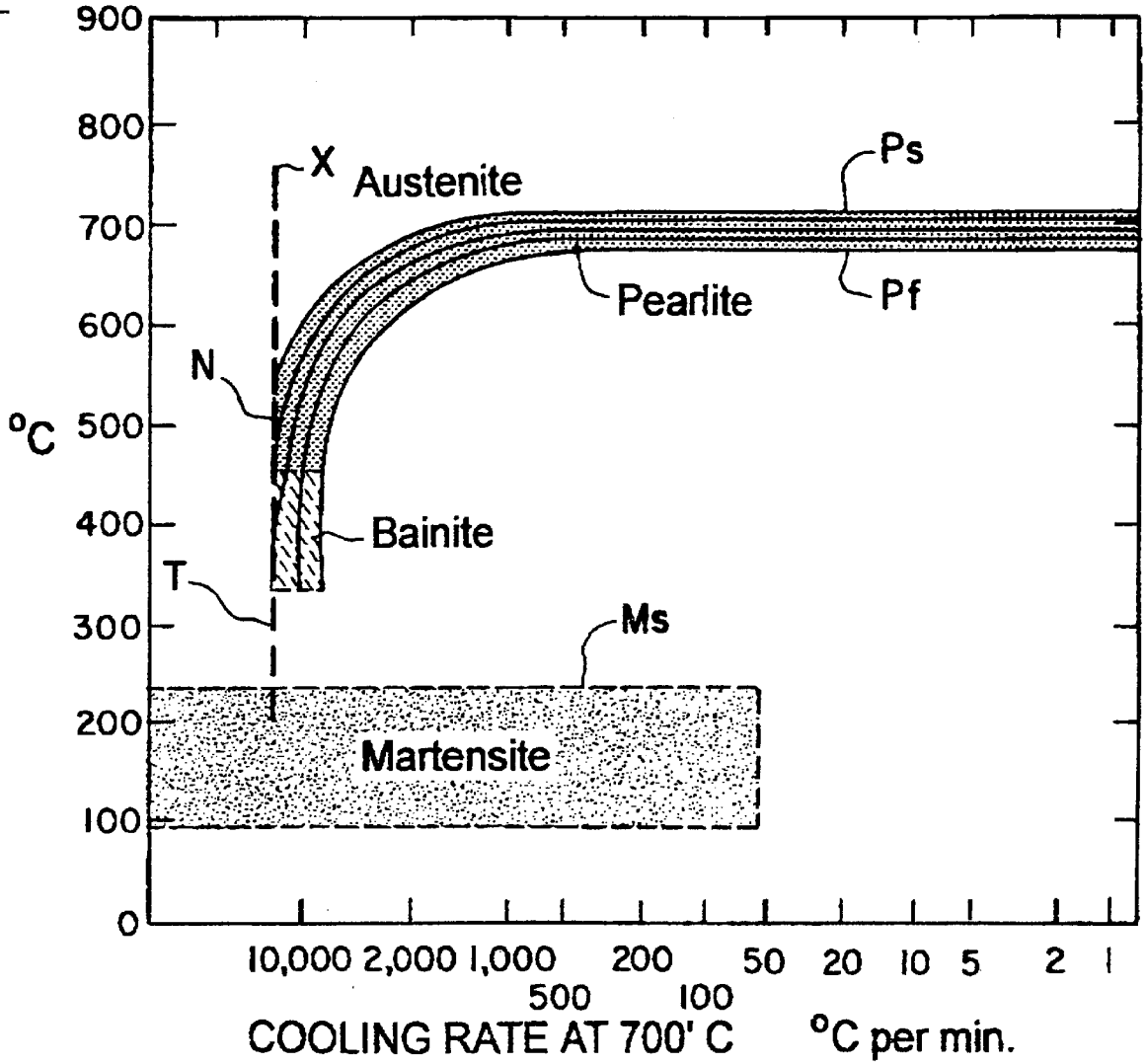
FIG. 6 is a continuous cooling transformation curve diagram showing the herein described steels' pearlite starting curve $P_s$ (and particularly its nose region N) shifted to the left (relative to its position in FIG. 5) to such an extent that the N region of $P_s$ encounters the steel's cooling curve T.

FIG. 6 shows a continuous cooling transformation curve diagram for a steel made according to the teachings of this invention. Among its other alloying ingredients, this steel should be regarded as having a 1.1 weight percent silicon concentration. As a result of this, a "nose" region N of the $P_s$ curve is shifted far enough to the left that it encounters a hot spot steel's cooling curve T before said cooling curve T descends to those martensite-producing temperatures (e.g., at about 250° C. as depicted by the $M_s$ curve of FIG. 6.

As was previously noted, in order to produce martensite, a steel must transform from a austenite crystalline material to a martensite crystalline material. Transformations from pearlite to martensite do not normally occur. Thus, applicants' shifting of the pearlite start curve $P_s$ to the left in FIG. 6 to such an extent that it encounters cooling curve T implies that the steel will take on a pearlitic structure before the descending cooling curve T reaches the steel's martensite forming conditions (i.e., before it reaches the martensite start curve $M_s$ and the regions under it). Thus, this steel will, to some degree, take on a pearlitic structure as a result of the cooling curve T encountering at least some portion (e.g., nose region N) of the pearlite start curve $P_s$, as the curve T descends toward the martensite starting curve $M_s$. Having taken on a pearlitic structure here, the steel will not transform to martensite as the temperature falls because, once again, martensite is only formed by a transformation from austenite. Again, it will not be formed from a transformation from pearlite.

This is even more true of a steel whose entire pearlite forming region $P_s$–$P_f$ is shifted well to the left of the steels cooling curve T. Thus, since martensite is formed only from austenite—and is not formed from pearlite—applicants' steels resist formation of a martensitic structure as the cooling curve T continues to descend as the steel returns to its normal, or pre-skid, temperature. In effect, the herein described martensite transformation resistant steels of this patent disclosure make these austenite to pearlite transformations in time periods that tend to be less than the heating and cooling time periods extant in railway skid situations (e.g., in time periods less than a second, and in many cases less than one tenth of a second).

Figure 7:
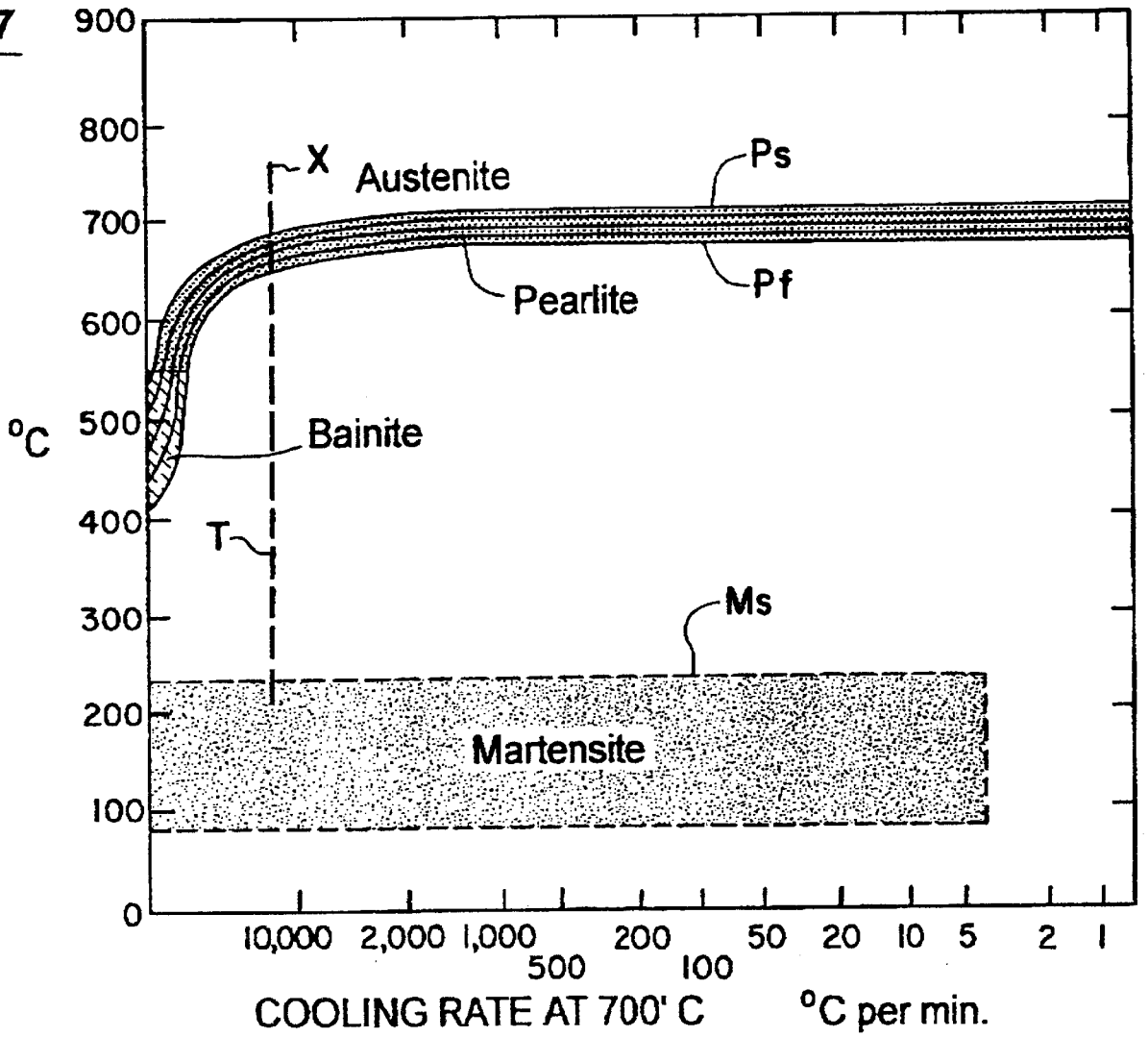
FIG. 7 is a continuous cooling transformation curve diagram showing a herein disclosed steel's pearlite forming region $P_s$–$P_f$ shifted to the left (relative to its position in FIG. 5) to such an extent that the pearlite forming region extends to the left of the T curve to such an extent that it approaches the Y (i.e., temperature) axis of the diagram.

Applicants have found that such a shift of the pearlite forming region (i.e., the region between $P_s$ and $P_f$) far enough to the left that it encounters (see FIG. 6) or, better yet, penetrates (see FIG. 7) the cooling curve T, can be achieved by formulating steels having unusually high silicon concentrations. Silicon concentrations of 1.1 to 3.0 percent by weight are preferred. Such 1.1 to 3.0 percent silicon concentrations are especially preferred in steels having carbon concentrations of 0.60 to 0.77 weight percent carbon. For example, FIG. 6 generally depicts the degree of shift of the $P_s$–$P_f$ region by use of a 1.1 percent silicon concentration in a steel having 0.60 to 0.77 percent carbon. FIG. 7 depicts the degree of shift produced by a 2.0 percent silicon concentration in a 0.60 to 0.77 percent carbon steel.

FIG. 7 illustrates a situation where the pearlite region between $P_s$ and $P_f$ is shifted well to the left of the cooling curve T. When compared, FIGS. 6 and 7 also show that applicants' use of these relatively high (i.e., 1.1 to 3.0 percent) silicon concentrations will tend to shift the right end of the martensite region farther and farther to the right as the silicon concentration is raised within the 1.1 to 3.0 percent range. However, because applicants' $P_s$ curve encounters and/or penetrates the cooling curve T, any rightward shift of the $M_s$ curve is of no great concern. Again, this follows from the fact that once the falling cooling curve T encounters the pearlite-forming conditions implicit in the $P_s$ curve, pearlite is formed. Thereafter transitions from pearlite to martensite do not occur.

Figure 8:
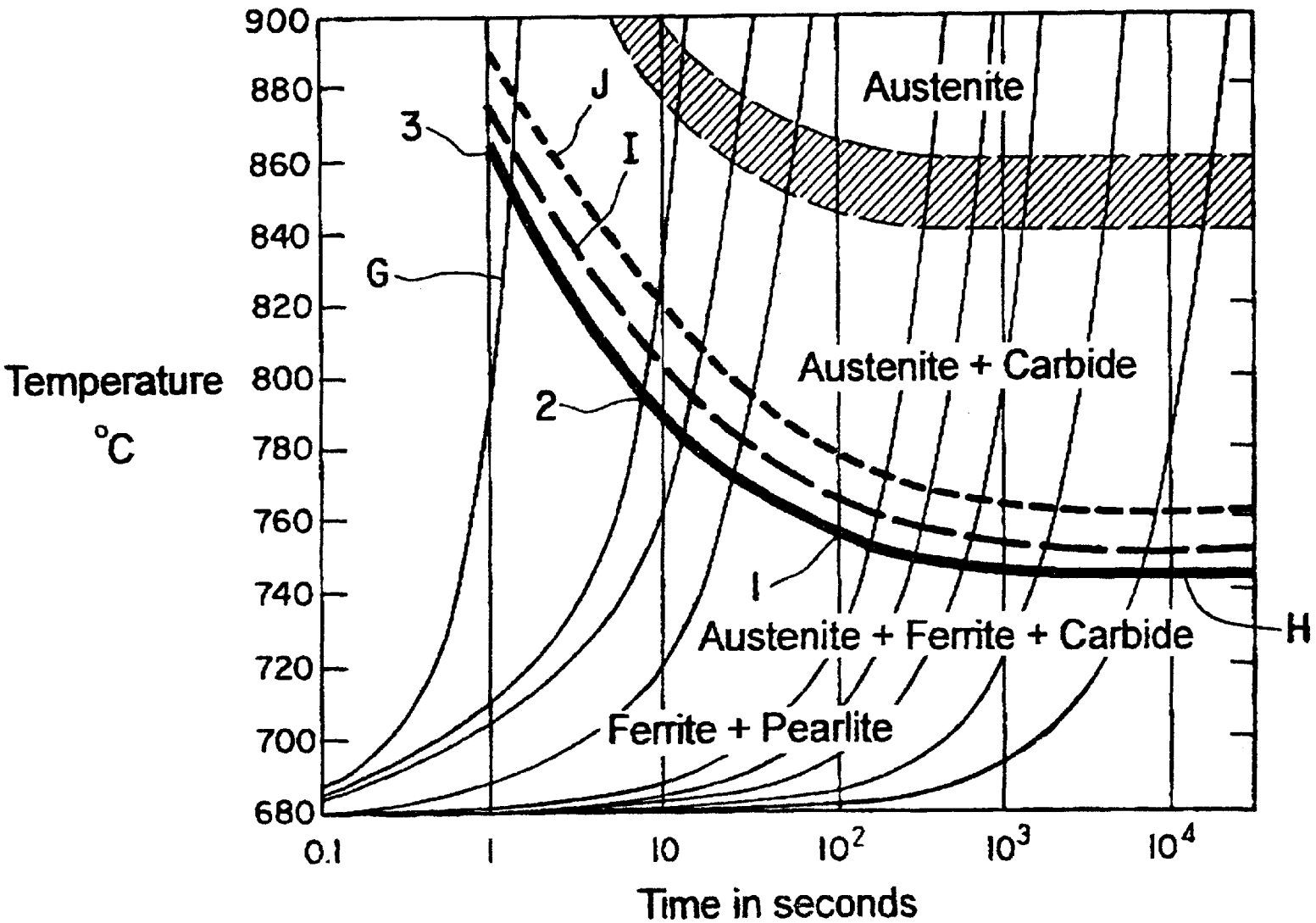
FIG. 8 depicts two separate upward shifts in a continuous heating transformation curve as a result of (1) adding 1.1 to 3.0 wt % silicon to a representative steel formulation and (2) adding 0.5 to 1.0 wt % chromium to that steel formulation.

FIG. 8 generally illustrates an effect that results from adding 1.1 to 3.0 silicon to a steel formulation of this patent disclosure. FIG. 8 also generally illustrates the effects of adding 0.5 to 1.0 weight percent chromium to a steel formulation of this patent disclosure. More specifically, FIG. 8 shows that, as a steel is heated more rapidly, its transformation from pearlite to austenite occurs at ever increasing temperatures. For example, in FIG. 8, the continuous heating transformation curve H for a 0.7 wt % carbon steel makes the pearlite—austenite transformation at about 756° C. (i.e., point 1 in FIG. 8) when heated in $10^2$ seconds (100 seconds). When heated for 10 seconds it makes this transition at about 790° C. At one second the transition takes place at about 862° C. Thus, as the heating time gets shorter, the pearlite-austenite transition temperature gets higher.

Applicants have found that the addition of 1.1 to 3.0 weight percent silicon to such a steel formulation shifts the transformation curve upward and to the left. This shift is generally depicted by the dashed line I in FIG. 8. Thus in the relatively short time periods, e.g., one second, with which this invention is concerned, the presence of the 1.1 to 3.0 silicon in the steel formulation tends to raise the transformation temperature to a higher temperature. Thus, austenite is less likely to be formed from the pearlite form of the steel under many heating conditions produced by wheel skids.

The presence of chromium in applicants' steel formulations shifts their transformation temperatures still higher and to the left. This additional shift is depicted by the dotted line J in FIG. 8. This effect is cumulative. Thus, as both silicon and chromium shift the continuous transformation curve for the steel upward and to the left, in shorter and shorter time periods, a pearlite to austenite transformation is made less likely to occur. Thus, the cumulative effects of the use of high silicon concentrations plus the use of 0.5 to 1.0 percent chromium is of even greater value in a railway wheel under the skid conditions previously described wherein heating and cooling occur very rapidly (e.g., in 1 second or less).

It also should be understood that various physical treatments of the steels having the formulations described in this patent disclosure may be employed during their manufacture to improve their metallurgical properties. Such physical operations may include quenching, hot working, cold working and the like. It also should be understood that, while this invention has been described in detail and with reference to certain specific embodiments thereof, various changes and modifications can be made therein without departing from the spirit and scope thereof.

Thus having disclosed our invention, what is claimed is:

1. A railway wheel made of a steel having a pearlitic structure and further comprising (by weight): 0.60 to 0.85 percent carbon, 2.0 to 3.0 percent silicon, 0.45 to 0.85 percent manganese, less than 0.050 percent sulfur and less than 0.050 percent phosphorus, with the remainder of said steel being iron and incidental impurities.

2. The wheel of claim 1 wherein the steel's carbon content is from 0.67 to 0.77 weight percent.

3. The wheel of claim 1 wherein the steel's manganese content is from 0.60 to 0.85 weight percent.

4. A railway wheel made of a steel having a pearlitic structure and further comprising (by weight): 0.60 to 0.85 percent carbon, 2.0 to 3.0 percent silicon, 0.45 to 0.85 percent manganese, 0.50 to 1.0 weight percent chromium, less than 0.050 weight percent sulfur and less than 0.050 weight percent phosphorus, with the remainder of said steel being iron and incidental impurities.

5. The wheel of claim 4 wherein the steel's carbon content is from 0.67 to 0.77 weight percent.

6. The wheel of claim 4 wherein the steel's manganese content is from 0.60 to 0.75 weight percent.

* * * * *